United States Patent [19]

Paton et al.

[11] 4,227,031

[45] Oct. 7, 1980

[54] NONCONSUMABLE ELECTRODE FOR MELTING METALS AND ALLOYS

[76] Inventors: Boris E. Paton, ulitsa Chkalova, 41a, kv. 26; Jury V. Latash, ulitsa Artema, 55, kv. 23; Georgy M. Grigorenko, Sapernoe pole, 26a, kv. 39, all of Kiev; Jury V. Lisovoi, Irpen, ulitsa Sovetskaya, 24; Viktor V. Stepanenko, Vasilkov 1, ulitsa Pushkina, 15, both of Kievskaya oblast; Grigory B. Asoiants, ulitsa Mechnikova, 18, kv. 19, Kiev, all of U.S.S.R.

[21] Appl. No.: 40,220

[22] Filed: May 18, 1979

[51] Int. Cl.[2] ..... H05B 7/08

[52] U.S. Cl. ..... 13/18 A; 13/11; 219/123

[58] Field of Search ..... 13/18 R, 18 A, 11; 219/123

[56] References Cited

U.S. PATENT DOCUMENTS

| | | | |
|---|---|---|---|
| 3,610,796 | 10/1971 | DeCorso | 13/18 A |
| 3,649,733 | 3/1972 | Schlienger | 13/18 A |
| 3,769,441 | 10/1973 | Schlienger | 13/18 A |
| 4,004,076 | 1/1977 | Paton et al. | 13/18 A |

*Primary Examiner*—Roy N. Envall, Jr.

*Attorney, Agent, or Firm*—Haseltine, Lake & Waters

[57] ABSTRACT

A nonconsumable electrode comprises a hollow cylindrical body, a hollow detachable tip made in the form of a body of revolution coaxial with the hollow cylindrical body, a solenoid for generating a magnetic field, and a partition. The tip is secured to one of the ends of the body and has lateral cylindrical non-arcing portion and a convex arcing end portion. The lower end of the solenoid is disposed in the tip cavity defined by the cylindrical non-arcing portion of the tip. The partition is coaxially mounted in the cavity of the body and of the tip so that between said partition and the walls of the body and of the tip there is formed a passageway for the flow of a coolant.

5 Claims, 6 Drawing Figures

NONCONSUMABLE ELECTRODE FOR MELTING METALS AND ALLOYS

BACKGROUND OF THE INVENTION

1. Field of the Invention

The present invention relates to heat sources, and particularly to a nonconsumable electrode for melting metals and alloys. Most advantageously the invention can be used in electrometallurgical installations for melting metals and alloys, in appratuses for the partial melting and building-up of ingots as well as for producing metals and alloys from lump charge in vacuum furnaces with a water-cooled mould or skull crucibles and in arc furnaces with a ceramic lining.

2. Description of the Prior Art

To provide a nonconsumable electrode which would be reliable in service and have a long service life is a long-standing problem. However, efforts made to solve this problem have not yielded satisfactory results so far.

The prior art consumable electrodes have a common principle of operation based on moving the arc spot around the arcing surface of the electrode tip. While moving over the arcing surface, the arc heats different places thereof, thereby causing its deformation, which decreases the length of the electrode life. The currently used nonconsumable electrodes reliably operate only from 40 to 100 hours and therefore are not capable of adequately satisfying requirements of the electrometallurgy, taking into account that the production of one large ingot takes 5–10 hours. Thus, the tip of the above nonconsumable electrode is capable of providing only a limited number of heats. Frequent replacement of costly tips of the nonconsumable electrodes brings down the efficiency of the melting process and raises production costs.

There are known nonconsumable electrodes for melting metals and alloys (cf. U.S. Pat. No. 3,649,733 and No. 3,651,239) comprising a hollow body to one end of which is secured a detachable hollow tip having an arcing surface, and wherein there is provided a partition mounted within the cavity of the body and of the tip so as to form between said partition and the walls of the body and of the tip a passageway for the flow of a coolant. These electrodes are installed in furnaces generally at a certain angle relative to the metal bath. In operation the electrode is rotated about its axis with about 250 r.p.m. While the electrode is rotated, the intensely hot spot of the electric arc established between the tip arcing surface and the melt moves over the arcing surface of the cooled tip, which accounts for its insignificant wear. Melting is effected with the aid of an electric arc of opposite polarity in which case the positive pole is connected to the nonconsumable electrode. Such a construction of a nonconsumable electrode permits production of metals and alloys from lump charge, managing without consumable electrodes. However, the presence of movable electric conductors and cooling-water supply conduits complicates the construction of this nonconsumable electrode. In addition, special drives are required for rotating such a nonconsumable electrode, which considerably complicates the melting apparatus as a whole. Furthermore, the complexity of vacuum sealing while lowering the electrode into a furance limits to a great extent the speed of its rotation, which in turn leads to using electrodes with a larger diameter (from 0.5 m and larger). All these disadvantages impair the reliability of these electrodes and bring down their thermal efficiency.

There are also known nonconsumable electrodes for melting metals and alloys (cf. U.S. Pat. No. 3,610,796 and British Pat. No. 1,325,522), comprising a hollow body with a hollow detachable electrode tip secured to one of the ends thereof and having an arcing surface, and a partition mounted in the cavity of the body and the tip so that between said partition and the walls of the body and of the tip a passageway is formed for the flow of a coolant. Disposed within the tip are permanent magnets. In the course of melting a powerful arc is established between the sparking surface of the tip and the metal being melted. The magnetic poles of the magnets are arranged in the cavity of the tip so as to cause the arc and hence the arc spot to move around the arcing surface, in which case the erosion of the arcing surface is minimized. Melting metal is generally effected by an arc having opposite polarity, which provides for a satisfactory durability of the electrode tip in the case of low velocity of the arc movement. However, the operational reliability of this nonconsumable electrode is achieved by using powerful permanent magnets, which results in the increase of the dimensions of the electrode and hence brings down its thermal efficiency. Moreover, the electrode tip has a special configuration, which complicates its manufacture and thereby raises its cost.

Known in the art are also nonconsumable electrodes for melting metals and alloys (cf. U.S. Pat. No. 3,368,018, No. 3,369,067 and No. 3,480,717), comprising a hollow body with a hollow detachable electrode tip secured to one of the ends thereof and having an arcing surface, and a partition mounted in the cavity of the body and the tip so that between said partition and the walls of the body and of the tip a passageway is formed for the coolant to pass therethrough, and wherein a solenoid is provided to set up a magnetic field for moving the electric arc ignited between the arcing surface and the metal to be melted, said solenoid being placed in a special housing made of magnetic material and disposed within the electrode tip. The electrode tip and the solenoid are fed from separate d.c. sources. In order to decrease the probability of break-down of the solenoid insulation said solenoid is fed from a low-voltage d.c. source. In the course of melting the solenoid produces a strong magnetic field which is superposed with the magnetic field of the arc, thereby causing the latter to move circularly on the arcing surface of the electrode tip. The necessary of setting-up of a strong radial magnetic field parallel to the arcing surface of the tip accounts for that the lower end of the solenoid is located as near as possible to the arcing surface. Moving the arc spot over the arcing surface of the tip provides for a high resistance thereof to erosion even at elevated temperatures at the intensely hot arc spot, ranging from 4 to $5.10^{10}$ kcal/m$^2$ per hour. The velocity of the arc movement is controlled by varying magnitude of the direct current feeding the solenoid. Melting metals with the aid of such nonconsumable electrode can be effected by an arc either of direct or opposite polarity. However, melting metals by the arc of direct polarity requires that the arc be moved with the velocity higher than 1000 m/sec., which can be achieved by setting-up of a strong magnetic field which, in turn, requires a current of a great magnitude for feeding the solenoid. Employing special sources of low voltage strong direct current for feeding solenoid requires additional space for the disposal thereof, raises the cost of the nonconsumable electrode, as well as complicates controlling the melting process and brings down the operational reliability of the electrode.

The above disadvantages have been overcome in the non-consumable electrode for melting metals and alloys (cf. U.S. Pat. No. 4,004,076) comprising a hollow cylindrical body with a hollow detachable electrode tip secured to one of the ends thereof, a solenoid intended for generating a magnetic field and being at least partially disposed within the electrode tip, and a partition coaxially mounted within the cylindrical body and the electrode tip so as to form between said partition and the walls of the body and of the tip a passageway for a coolant to pass therethrough. The hollow tip is formed as a body of revolution coaxial with the cylindrical body and has a lateral cylindrical non-arcing surface and a toroidal arcing and surface. The solenoid turns are made in the form of helical projections on the lateral wall of the hollow tip and connected in series to a d.c. source. The lower end surface of the solenoid is disposed in proximity to the arcing surface of the tip in order to set up a high radial magnetic field parallel to the arcing surface thereof. When the arc is ignited between the arcing surface to the tip and a metal to be melt, the current from a common source flows through the projections formed by the helical groove on the lateral wall of the tip and through the lateral wall thereof, thus generating a magnetic field. Since the electric arc generates its own magnetic field, the magnetic field generated by the helical projection on the lateral wall of the tip, being superposed with the arc magnetic field, causes the arc to move along a circular path on the arcing surface with a predetermined velocity. The solenoid turns being seriesly connected in the arc circuit rules out the necessity of using additional d.c. sources, which simplifies the control over the melting process and enhances its reliability. In addition, a nonconsumable electrode wherein the solenoid turns are helical projections formed on the lateral wall of the tip cooled by a coolant, has a simple construction and a long useful life. However, the arc hot spot moving over the toroidal arcing surface of the tip produces varying thermal fields in the material thereof, whereby causing deformation of the tip surface, which considerably decreases the service life of the electrode tip. Furthermore, a rotating high-power electric arc renders electrical parameters unstable. At the same time, a toroidal arcing surface necessitates the presence of an axial cavity the diameter of which should be not less than the diameter of the arc hot spot, which is necessary for providing a stable circular arc movement. Otherwise, the arc may change from the circular to a straightline path along the diameter of the tip thereby, causing destruction thereof. With the increase of the axial cavity diameter the diameter of the whole nonconsumable electrode also increases, which brings down a thermal efficiency of the furnace as a result of thermal losses. In operation, on the walls of the axial cavity of the tip arcing surface there are condensed vapors and spatters of molten metal, which changes the configuration of the arcing surface and affects the stability of the arc movement. On the other hand in order to set up a high radial magnetic field parallel to the arcing surface of the tip, the lower end surface of the solenoid should be disposed as near to the arcing surface of the tip as possible. For cooling the tip, and especially the arcing surface thereof the passageways of a certain cross-section have to be formed to enable a coolant to pass between the lower end surface of the solenoid and the arcing surface of the tip. With the increase of the cross-section of the passageways the distance between the lower end surface of the solenoid and the arcing surface decreases thereby lowering the magnetic field intensity, whereas decreasing the cross-section of these passageways leads to the necessity of increasing the pressure in the coolant supply system which in the case of melting highly reactive metals may cause destruction of the walls of the tip.

SUMMARY OF THE INVENTION

The main object of the invention is to provide a nonconsumable electrode for melting metals and alloys, featuring a reliable operation and a long service life.

The other main object of the invention is to provide stable electrical parameters of the electrode in the course of melting.

Another object of the invention is to reduce thermal losses during the melting, and to thereby improve the thermal efficiency of a furnace.

Still another object of the invention is to provide a trouble-free service of nonconsumable electrodes.

Yet another object of the invention is to provide an intensive cooling of the arcing surface of a nonconsumable electrode in the process of melting.

These and other objects of the invention are attained in that in a nonconsumable electrode for melting metals and alloys, comprising a hollow cylindrical body to one end of which is secured a detachable hollow tip made in the form of a body of revolution coaxial with the hollow cylindrical body and having a lateral cylindrical non-arcing portion and a curvilinear arcing end portion, a solenoid intended for generating a magnetic field and having at least a portion disposed within the tip, and a partition coaxially mounted inside the body and the tip so that between said partition and walls of the body and of the tip there is formed a passageway for the flow of a coolant, according to the invention the arcing portion of the electrode tip is formed convex and a lower end of the solenoid is located in the tip cavity portion defined by the cylindrical non-arcing portion of the tip.

The convex configuration of the tip arcing portion and location of the lower end of the solenoid inside the tip, as described above, rules out circular motion of the arc spot as well as its moving into the lateral wall of the tip and of the body of the nonconsumable electrode. At the same time such arrangement provides for stabilizing the longitudinal component of the solenoid magnetic field on the convex arcing portion of the electrode tip. The solenoid magnetic flux lines are so distributed along the arcing portion that the location of the arc spot as a result of the arc diamagnetism is limited by the minimum intensity zone of the solenoid magnetic field. This decreases deformation of the tip arcing surface in the process of melting, thereby enhancing the operational reliability of the electrode for a long period of time, and provides for the stability of the electrical parameters thereof. In addition, the above construction of a nonconsumable electrode tip permits the diameter of a nonconsumable electrode to be decreased, due to the absence of the axial cavity inside the electrode tip, and the thermal efficiency of a furnace to be enhanced. It also enables prevention of breakdowns which may be caused as a result of the arc intensely hot spot shifting to the lateral surface of the tip and of the tip and of the body of the electrode thereby causing burn-through thereof. The location of the solenoid lower end inside the tip as described above provides for intensive cooling of the tip arcing portion in the process of melting, which also decreases the possibility of burn-through thereof.

The simplest in manufacture and the most reliable in operation is such an embodiment of the proposed nonconsumable electrode wherein the tip arcing portion is shaped as a semisphere. The nonconsumable electrodes with such a configuration of the electrode tip arcing portion are used in electrometallurgical installations wherein metals are treated under pressure from $10^{-5}$ mm Hg to 760 mm Hg.

When nonconsumable electrodes are used in the electrometallurgical installations, wherein metals are treated under the pressure from $10^{-5}$ mm Hg to 760 mm Hg, it is advisable that the tip arcing portion be shaped as a paraboloid of revolution, which improve the stability of the arc ignited between the arcing surface and the molten metal.

In the case of treating metals under the pressure higher than 760 mm Hg, it is expedient that the electrode tip arcing portion be shaped as a portion of an ellipsoid of revolution, which decreases a specific heat flow from the intensely hot arc spot to the electrode body.

In case the treating of metals with the aid of a nonconsumable electrode is effected under the pressure from $10^{-5}$ mm Hg to $10^{-2}$ mm Hg, it is advisable that the electrode tip arcing portion be shaped as a portion of a parted hyperboloid, which improves the stability of the arc in vacuum.

BRIEF DESCRIPTION OF THE DRAWINGS

The invention will now be explained with reference to embodiments thereof which are represented in the accompanying drawings, wherein.

DETAILED DESCRIPTION OF THE INVENTION

Figure 3:
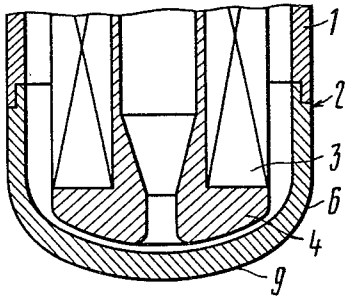
FIG. 3 is an axial elevation of the lower portion of the nonconsumable electrode provided with a tip having the arcing portion in the form of an ellipsoid of revolution.
Figure 4:
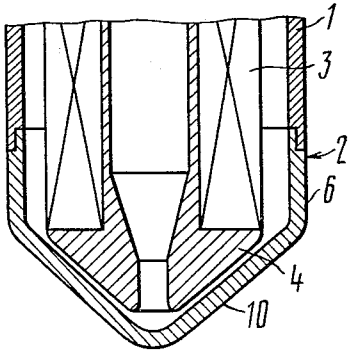
FIG. 4 is an axial elevation of the lower portion of the nonconsumable electrode provided with a tip having the arcing portion in the form of a parted hyperboloid.

The proposed nonconsumable electrode for melting metals and alloys comprises a hollow cylindrical body 1 (FIG. 1) to one end of which is secured a detachable hollow tip 2, and a solenoid 3 for generating a magnetic field, at least a portion of said solenoid being disposed in the cavity of said tip 2. Inside the body 1 and the tip 2 there is provided a partition 4 coaxially mounted in a manner that between said partition 4 and the walls of the body 1 and of the tip 2 there is formed a passageway for the flow of a coolant. The partition 4 is fixed at one its edge to the buttend wall 5 of the body 1. The hollow tip 2 is made in the form of a body of revolution coaxial with the body 1 and has a lateral cylindrical nonarcing portion 6 and a convex arcing end portion, which may be otherwise shaped. The most reliable in operation and convinient in manufacture is an alternative embodiment of the tip 2 wherein the arcing portion is shaped as a semisphere 7. According to the invention the arcing portion of the tip may be shaped as a paraboloid of revolution 8 (FIG. 8), or as a portion of an ellipsoid of revolution (FIG. 3), or as a portion of a parted hyperboloid (FIG. 4). The lower end of the solenoid 3 is disposed in the tip 2 cavity (FIG. 1) defined by the cylindrical non-arcing portion 6. Mounted into the end wall 5 is an inlet sleeve 11 for supplying a coolant, said inlet sleeve 11 communicating coolant supplying system (not shown) with a cavity defined by the walls of the partition 4. Mounted into the lateral wall of the body 1 is an outlet sleeve 12 intended for withdrawing the coolant, said outlet sleeve 12 communicating the coolant supply system (not shown) with the passageway formed between the partition 4 walls and the walls of the body 1 and of the tip 2.

Figure 5:
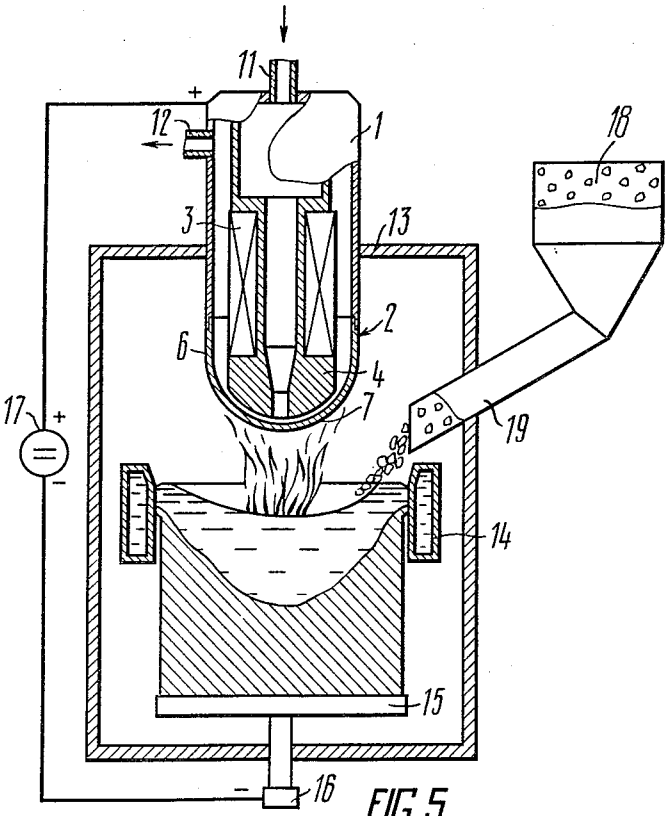
FIG. 5 is an elevation of an arc furnace with the nonconsumable electrode the tip and the solenoid of which are connected in series to a common d.c. source.

Shown in FIG. 5 is an arc furnace provided with a nonconsumable electrode. The body 1 of the nonconsumable electrode is hermetically mounted for reciprocal movement in the roof of the furnace melting chamber 13. Mounted inside the melting chamber 13 is a water-cooled mould 14 which is arranged coaxially with the body 1 of the nonconsumable electrode. The water cooled mould 14 is fitted with a bottom plate 15 capable of being reciprocally moved with the aid of a rod 16. The hollow tip 2 is connected in series, through the body 1 of the nonconsumable electrode, to a d.c. source 17 whereto through the rod 16 are also connected in series the solenoid 3 and the bottom plate 15. Into one of the lateral walls of the melting chamber 13 there is hermetically mounted a hopper 18 having its sleeve 19 outlet opening disposed above the cavity of the mould 14.

Figure 6:
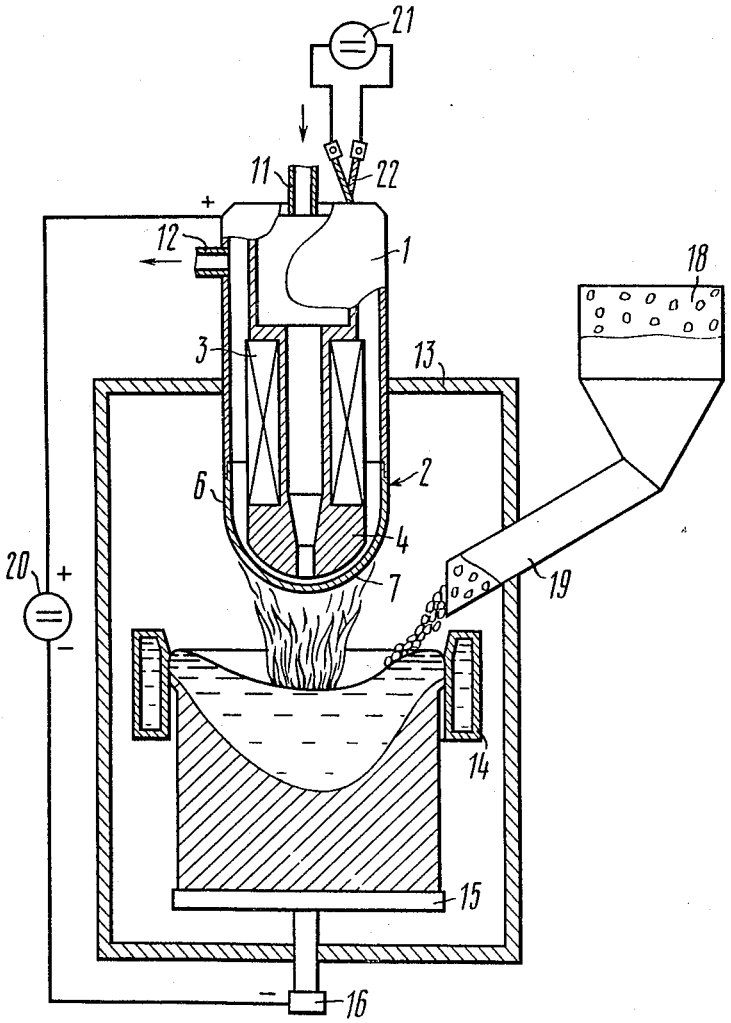
FIG. 6 is an elevation of an arc furnace fitted with the nonconsumable electrode whose solenoid and tip are connected to separate d.c. sources.

Illustrated in FIG. 6 is an arc furnace equipped with the nonconsumable electrode wherein the solenoid 3 and the electrode tip 2 are connected to different d.c. sources. According to this embodiment the hollow tip 2 and the bottom plate 15 are connected in series to a d.c. source 20 through the body 1 of the nonconsumable electrode and the rod 16 respectively, whereas the solenoid 3 is coupled with a d.c. source 21 through the outlet 22.

An arc furnace equipped with the proposed nonconsumable electrode operates as follows.

The water-cooled mould 14 (FIG. 5) located inside the melting chamber 13 is charged with lump charge fed from the hopper 18 through the sleeve 19. After a certain quantity of the furnace charge is charged and a predetermined pressure is built up in the melting chamber 13, the nonconsumable electrode is lowered until the distance between the peak of the arcing surface (in this particular case the peak of the semisphere 7) of the tip 2 and the lump charge assumes a value required for igniting the electric arc. Thereafter the tip 2 and the solenoid 3 of the nonconsumable electrode, and the bottom plate 15 of the furnace are energized by the direct current from the source 17. The electric arc is ignited by that the electrode tip 2 is first brought into contact with the charge and then is raised so as to form an arc gap. Being energized the solenoid 3 generates a magnetic field. The hot spot of the arc whose magnetic field interacts with the magnetic field of the solenoid 3, is oriented in the area of the minimum intensity of the magnetic field of the solenoid 3, which is located in the peak region of the tip 2 arcing portion. The intensity of the magnetic field of the solenoid 3 increases from the arcing portion peak towards the non-arcing portion 6 of the tip 2. Such distribution of the solenoid 3 magnetic field over the arcing portion of the electrode tip 2 is achieved owing to above-described relative positions of the solenoid 3 and the arcing portion as well as the configuration of the arcing portion which is made in this particular case in the form of a semisphere 7). This provides for a stabilized spatial position of the arc spot since in the arcing area the axial component of the solenoid 3 magnetic field is greater than the radial component thereof. In the process of melting the arc current fed from the source 17 is adjusted by varying its magnitude and the arc gap length. Melting metal is effected by the arc having either direct or reversed polarity.

As the charge melts, the botton plates 15 is lowered with the aid of the rod 16 thereby withdrawing a thus obtained ingot. At the same time the mould 14 is continually charged through the sleeve 19 with lump charge from the hopper 18.

In the course of melting the heat is continuously conducted away from the surface of the body 1 and the tip 2, which is achieved by continuously supplying a coolant to the nonconsumable electrode. The coolant is delivered through the inlet pipe 11, passed through the cavity defined by the walls of the partition 4 and then withdrawn through the outlet pipe 12, conducting the heat away from the walls of the body 1 and of the tip 2 of the nonconsumable electrode.

Figure 1:
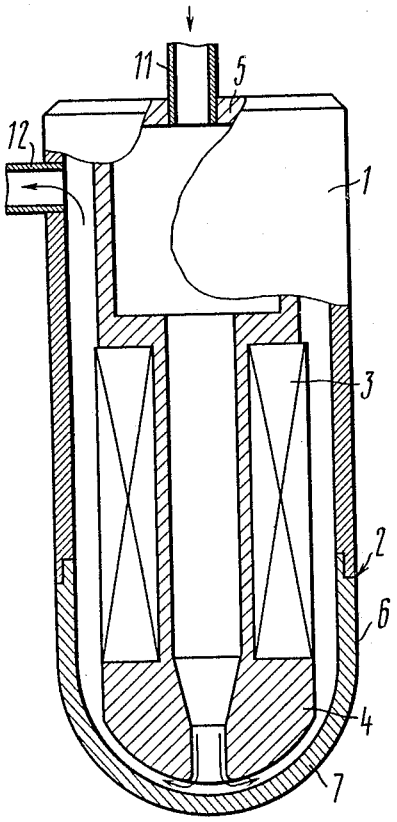
FIG. 1 is an axial elevation of the nonconsumable electrode provided with a tip having the arcing portion in the form of a semisphere.
Figure 2:
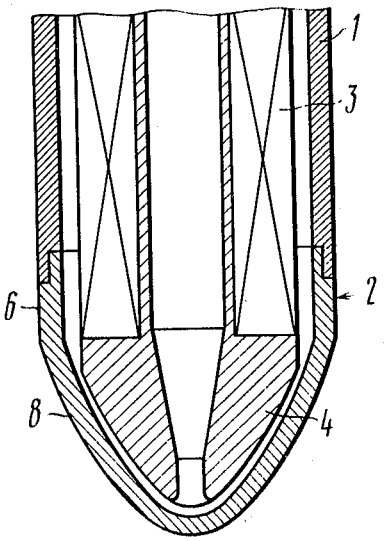
FIG. 2 is an axial elevation of the lower portion of the nonconsumable electrode provided with a tip having the arcing portion in the form of a paraboloid of revolution.

The melting of metals can be effected in vacuum and under pressure. The most expedient shape of the tip 2 arcing portion for operation under the pressure from $10^{-5}$ mm Hg to 760 mm Hg is the semisphere 7 (FIG. 1). For operation under the pressure from $10^{-2}$ mm Hg to 760 mm Hg, it is advisable that the arcing portion of the electrode tip be shaped as a paraboloid of revolution (FIG. 2). When the melting is effected under the pressure higher than 760 mm Hg, it is advisable that the arcing portion of the tip 2 be shaped as a portion of an ellipsoid of revolution 9 (FIG. 3). In the case of melting metals under the pressure from $10^{-5}$ mm Hg to $10^{-2}$ mm Hg, it is expedient that the arcing portion of the electrode tip 2 be shaped as a portion of a parted hyperboloid 10.

In the case of an arc furnace shown in FIG. 6, the melting process is essentially similar to that described above, with the difference that first the magnetic field of the solenoid 3 is set up by feeding the solenoid with direct current from the source 21, and then the electric arc is ignited by energizing the electrode tip 2 and the bottom plate 15 with direct current from the d.c. source 20. This method is used for melting metals with high content of gases, applying low currents.

Thus, the above nonconsumable electrode when used for melting metals and alloys in arc furnaces enables the total and specific heat flow from the intensity hot arc spot to the hollow tip 2 of the nonconsumable electrode to be considerably reduced. This is achieved by decreasing potential drop at the electrode due to a stabilized position of the arc spot. The stabilized arcing causes less intensive heat exchange with the environment, which results in the lower axial and radial temperature gradients of the gas medium within the arc discharge space. With the decrease of the temperature axial gradient the arcing region close to the electrode decreases, thereby decreasing the potential drop at the electrode. With the decrease of the temperature radial gradient within the arc discharge space the diameter of the arc spot increases. Taken in combination these two factors enable the specific heat flow within the arc spot to be decreased from 1 to $2.10^4$ kW/m$^2$. The heat flow of such magnitude is easily conducted away by known in the art methods. A stabilized arc having low specific heat flows passing through the arc spot does not cause in the material of the electrode tip 2 high thermal and mechanical stresses, thereby decreasing deformations and specific erosion of the tip 2 from $10^{-9}$ to $10^{-8}$ g/C and, hence, increases the service live of the electrode tip 2 from 300 to 500 hours.

While particular embodiments of the invention have been shown and described, various modifications thereof will be apparent to those skilled in the art, and the departures may be made therefrom within the spirit and scope of the invention as defined in the claims.

What we claim is:

1. A nonconsumable electrode for melting metals and alloys, comprising:

a hollow cylindrical body;

a hollow detachable tip made in the form of a body of revolution coaxial with said hollow cylindrical body and secured to one of the ends thereof, said hollow tip having:

a lateral cylindrical non-arcing portion;

a convex arcing end portion;

a solenoid, for generating a magnetic field, having its lower end located within the cavity of said tip, said cavity being defined by said lateral cylindrical non-arcing portion of said hollow tip;

a partition coaxially mounted in the cavity of said hollow body and of said hollow tip so that between said partition and the walls of said hollow body and of said hollow tip a passageway is formed for the flow of a coolant.

2. A nonconsumable electrode according to claim 1, wherein the arcing portion of said hollow tip is shaped as a semisphere.

3. A nonconsumable electrode according to claim 1, wherein the arcing portion of said hollow tip is shaped as a paraboloid of revolution.

4. A nonconsumable electrode according to claim 1, wherein the arcing portion of said hollow tip is shaped as a portion of ellipsoid of revolution.

5. A nonconsumable electrode according to claim 1, wherein the arcing portion of said hollow tip is shaped as a portion of a parted hyperboloid.

* * * * *